US008926266B2

(12) United States Patent
Beyer et al.

(10) Patent No.: US 8,926,266 B2
(45) Date of Patent: Jan. 6, 2015

(54) MULTI-INLET VACUUM PUMP

(75) Inventors: Christian Beyer, Cologne (DE); Markus Henry, Cologne (DE); Heinz Englaender, Linnich (DE)

(73) Assignee: Oerlikon Leybold Vacuum GmbH, Cologne (DE)

( * ) Notice: Subject to any disclaimer, the term of this patent is extended or adjusted under 35 U.S.C. 154(b) by 510 days.

(21) Appl. No.: 13/203,309

(22) PCT Filed: Feb. 23, 2010

(86) PCT No.: PCT/EP2010/052282

§ 371 (c)(1), (2), (4) Date: Aug. 25, 2011

(87) PCT Pub. No.: WO2010/097384

PCT Pub. Date: Sep. 2, 2010

(65) Prior Publication Data

US 2011/0311348 A1 Dec. 22, 2011

(30) Foreign Application Priority Data

Feb. 28, 2009 (DE) ..... 10 2009 011 082

(51) Int. Cl.
*F04D 19/04* (2006.01)

(52) U.S. Cl.
CPC ..... *F04D 19/046* (2013.01); *F04D 19/042* (2013.01)
USPC ..... 415/90

(58) Field of Classification Search
USPC ..... 415/1, 90, 99, 100, 101, 102, 103, 109, 415/115, 120; 416/1, 198 R, 199, 201 R, 416/198 A; 417/250
See application file for complete search history.

(56) References Cited

U.S. PATENT DOCUMENTS

| | | | | |
|---|---|---|---|---|
| 5,116,196 | A | 5/1992 | Baret et al. | |
| 5,733,104 | A | 3/1998 | Conrad et al. | |
| 6,030,189 | A | 2/2000 | Bohm et al. | |
| 6,106,223 | A | 8/2000 | Leyshon | |
| 2003/0086784 | A1 * | 5/2003 | Stuart | 415/90 |

(Continued)

FOREIGN PATENT DOCUMENTS

| | | | |
|---|---|---|---|
| EP | 0464292 | A1 | 1/1992 |
| EP | 0919726 | A1 | 6/1999 |
| WO | 2006048603 | A1 | 5/2006 |

*Primary Examiner* — Edward Look
*Assistant Examiner* — Danielle M Christensen
(74) *Attorney, Agent, or Firm* — Fay Sharpe LLP

(57) ABSTRACT

A multi-inlet vacuum pump includes a first pump device (10) including a first rotor element (18) with a plurality of first rotor disks (20) serially arranged in the conveying direction (36), and a second pump device (12) including a further rotor element (26) with a plurality of second rotor disks (28) serially arranged in the conveying direction (36). A diameter of the second rotor disks (28) is at least partially larger than a diameter of the first rotor disks (20). A main inlet (32) sucks in a first fluid stream (34) with the first pump device (10). The first fluid stream (34) is conveyed in the direction of the further pump device (12). An intermediate inlet (38) sucks in a second fluid stream (40) with the second pump device (12). The second fluid stream (40) is conveyed in the direction of a pump outlet. A process of merging the two fluid streams (34,40) will occur within the second pump device (12), preferably between two adjacent second rotor disks (28) of the second pump device (12).

12 Claims, 3 Drawing Sheets

(56) References Cited

U.S. PATENT DOCUMENTS

2007/0020116 A1* 1/2007 Stones ..... 417/201
2007/0081889 A1* 4/2007 Englander ..... 415/90
2009/0035123 A1 2/2009 Stones

* cited by examiner

MULTI-INLET VACUUM PUMP

BACKGROUND

The present invention relates to a multi-inlet vacuum pump.

Multi-inlet vacuum pumps comprise, in a common housing, a plurality of pump devices provided e.g. as turbomolecular pumps, optionally in connection with a Holweck stage. The individual pump devices are usually carried by a common rotor shaft and driven by a single electric motor. The pump housing comprises a main inlet provided for suctional intake of a first fluid stream by operation of the first pump device. After passing through the first pump device, the first fluid stream will be conveyed in the direction of an outlet by the second pump device and optionally by further pump devices. Between the first and second pump devices, an intermediate inlet is provided for suctional intake of a second fluid stream by operation of the second pump device. The second pump device will thus convey the first and second fluid streams in the direction of the outlet. Optionally, a second intermediate inlet can be provided between the second pump device and a third pump device. By the third pump device, also a corresponding third fluid stream is conveyed in the direction of the outlet, wherein, thereafter, all of said three fluid streams are conveyed by the third pump device.

From EP 0 919 726 (U.S. Pat. No. 6,106,223), a multi-inlet pump is known wherein the outer diameter of the rotor disks of the first pump device is smaller than the outer diameter of the rotor disks of the second pump device. Thereby, a relatively high suction capacity is realized at the intermediate inlet.

It is an object of the invention to provide a multi-inlet vacuum pump which has an improved partial pressure and offers the possibility of an increased suction capacity at the intermediate inlet.

SUMMARY

In accordance with one aspect, a multi-inlet vacuum pump comprises a first pump device and a second pump device which preferably are turbomolecular pumps. The first pump device comprises a first rotor element including a plurality of rotor disks arranged serially in the conveying direction. The second pump device comprises a further rotor element which again includes a plurality of rotor disks arranged serially in the conveying direction. The multi-inlet vacuum pump comprises at least two pump devices while, optionally, also a larger number of pump devices can be provided. The multi-inlet vacuum pump has a main inlet via which a first fluid stream is sucked by the first pump device and is then conveyed towards the further—particularly the second—pump device. Via an intermediate inlet, a further fluid stream is sucked by said further pump device. Optionally, a plurality of intermediate inlets as well as a plurality of pump devices are provided, said intermediate inlets being with preference arranged between two adjacent pump devices. The preferably two fluid streams are conveyed in the direction of a pump outlet.

According to another aspect, a merging of the fluid streams does not take place directly in the region of the intermediate inlet. Thus, the merging of the preferably two fluid streams is performed in a region not located within the intermediate inlet but within the vacuum pump. Since the gas mixture sucked via the main inlet possibly has a different composition from that of the gas mixture sucked via the intermediate inlet, the inventive merging of the fluid streams in a region in a region not located within the intermediate inlet is advantageous because the ratio between the partial pressures will thus be affected to a lesser degree. Preferably, the merging of the fluid streams is performed only within said further pump device, particularly between two adjacent rotor disks of the second pump device. With preference, the merging is to take place between the first and second rotor disks of the further pump device.

In a multi-inlet pump comprising a second intermediate inlet or still further intermediate inlets, the region between the second and third pump devices and, respectively, between adjacent pump devices in general can of course be configured in a manner corresponding to the one described above. Herein, the merging of e.g. the second and third fluid stream will be performed in a region not located within the relevant intermediate inlet, preferably within the e.g. third pump device.

The diameter of the further, e.g. second, rotor disk is preferably at least partially larger than the diameter of the first rotor disk. Preferably, the diameter of a plurality—and particularly, all—of the rotor disks of the further pump device is larger than the diameter of the first rotor disk.

According to a preferred embodiment, at least the first rotor disk of the further pump device is formed with a through opening in the conveying direction, i.e. preferably in the axial direction of the rotor shaft. Via this through opening, the first fluid stream will flow at least partially, and preferably completely, into the further, e.g. second, pump device. The through opening is arranged preferably radially within the first rotor disk of the further pump device, which carries the vanes. The merging of the fluid streams is thus effected after the first fluid stream has passed the through opening. Since only the first rotor disk of the further pump device comprises through holes, the merging of the fluid streams will take place between the first and the second rotor disks of the further pump device. Optionally, also a plurality of rotor disks of the further pump device can be provided with through holes so that a merging of the fluid streams will be performed not only between the first and second rotor disks but also between further rotor disks of the further pump device. In case that, according to a preferred embodiment of the invention, at least a part of the rotor disks of the further pump device have a larger diameter than the rotor disks of the first pump device, the provision of such through openings has the effect that, due to the change of the diameters of the rotor disks, the first fluid stream does not have to be deflected radially outwards so that no merging of the two fluid streams will occur directly in the region of the intermediate inlet. Instead, a merging of the two fluid streams will occur e.g. no sooner than between the first and second rotor disks of the second pump device. Further, it can be provided that also further rotor disks of the second pump device have through openings so that the merging of the two fluid streams will take place not only between two rotor disks but between a larger number of rotor disks. This makes it possible to reduce the total cross-sectional area of the through openings in the conveying direction so that, at all times, a part of the first fluid stream will be forced to merge with the second fluid stream between two adjacent rotor disks and a smaller part of the first fluid stream will flow on in an unmerged condition, and a merging with the second fluid stream will occur only between the next two adjacent rotor disks.

The through opening provided at least in the first rotor disk of the further pump device preferably comprises a plurality of individual openings. Preferably, these individual openings are arranged along a circular line. Thereby, it is safeguarded that the stability of the rotor disks is not affected by the provision of a plurality of individual openings, which preferably are arranged in a regular configuration on a circular line.

In order to prevent that a larger part of the first fluid stream will flow not via said through openings but radially outwardly in the direction of the intermediate inlet, it is provided according to a preferred embodiment that a preferably radially oriented housing wall is arranged between adjacent pump devices. Preferably, said housing wall is sealingly connected to a housing outer wall of the pump housing and extends to the close vicinity of the through opening or of the rotor shaft. Preferably, said housing wall is configured to the effect that an annular opening is formed between the housing wall and the rotor shaft. When viewed in the flow direction, the through openings formed in the one or the plurality of rotor disks of the further pump device are arranged within said annular opening. Thereby, it is avoided that a deflection of the first fluid stream may occur between said annular opening and the through openings. Thus, the first fluid stream, after emerging from the first pump device, will flow via the through opening of the housing wall and then via the through opening of the first rotor disk or the plurality of rotor disks of the further pump device, to then be merged with the second fluid stream in the further pump device.

According to a further preferred embodiment which is a further realization of the inventive principle that the merging of the two fluid streams does not occur within an intermediate inlet, a flow channel is formed between adjacent pump devices. The at least one flow channel is arranged to connect an outlet of the first pump device to a region within the further pump device.

Preferably, the above effect is achieved in that the at least one flow channel is at least partially arranged within a rotor shaft carrying the rotor elements. According to a preferred embodiment, the rotor shaft, for forming a flow channel, is provided with a groove preferably extending in the longitudinal direction. Thus, in case of a provision of a plurality of flow channels, a plurality of grooves are provided, preferably extending parallel to each other in the longitudinal direction of the rotor shaft. The grooves herein are preferably located symmetrically on the periphery of the rotor shaft. Preferably, the grooves are formed in an outer peripheral surface of the rotor shaft, e.g. by milling. For forming a flow channel which is closed in the circumferential direction, it is according to a first embodiment provided that the grooves are covered by a shell and/or by an inner side of a rotor element. In this especially preferred embodiment, the first fluid stream after passing through the first pump device will flow, preferably completely so, into the flow channels which preferably are provided in a plural number. The first fluid stream will pass through the flow channels and will then exit again from the flow channels, with preference within a further pump device and more preferably within the adjacent pump device. In this manner, a merging of the first fluid stream with a further fluid stream which is sucked via an intermediate inlet, will take place not within the intermediate inlet but within the second pump device.

According to a further embodiment, the rotor shaft is formed as a hollow shaft. Preferably, the first fluid stream, once it has passed through the first pump device, will flow via one or a plurality of first transverse bores formed in the rotor shaft, into the flow channel and respectively into the rotor shaft. Preferably, a plurality of first transverse bores are provided, distributed radially on the periphery of the hollow shaft. Via at least one and preferably a plurality of transverse bores, the first fluid stream will be guided, preferably from the flow channel and respectively from the interior of the hollow rotor shaft, into the further pump device. According to a particularly preferred embodiment, this is performed between two adjacent rotor disks of the second pump device, particularly in the conveying direction between the first and second rotor disks. It is also possible to arrange the second transverse bores in a manner causing the inflow of the first fluid stream to take place in a plurality of regions of the second pump device, i.e. for example between the first and second rotor disks and also between the second and third rotor disks.

According to a modification of the above embodiment of the invention comprising flow channels and preferably grooves, it is provided that a sealing disk is arranged in the outlet region of the first pump device. Said sealing disk, preferably extending radially, is effective to safeguard that the first fluid stream will for the most part, and preferably completely, be guided in the direction of said at least one flow channel. Herein, the sealing disk can be configured and respectively arranged in correspondence to the stator disks which are located between adjacent rotor disks. The sealing disk can be held in the housing via a stator ring in manner similar to the arrangement of the stator disks, or it can be tightly connected to the housing. The sealing disk extends to a region close to the rotor shaft so that a small sealing gap is formed between the sealing disk and the rotor shaft. If a sealing disk is provided, the inlet of the groove or grooves is preferably arranged between the last rotor disk of the first pump device and the sealing disk when viewed in the conveying direction.

According to a further preferred embodiment, it is provided, instead of installing a sealing disk, that at least the last rotor disk of the first pump device is configured to generate a counterflow. The conveying direction of this last rotor disk of the first pump device is thus opposite to the main conveying direction of the vacuum pump. By this rotor disk, a part of the further fluid stream sucked via the intermediate inlet will be conveyed in a direction opposite to the main conveying direction, i.e. in the direction of the first pump device. In this further preferred embodiment, the first transverse bores and/or the inlet of the grooves are arranged between the last two rotor disks of the first pump device, i.e. between the last rotor disk generating a counterflow and the last rotor disk of the pump device that is operative for conveyance in the main direction of conveyance. By the generated counterflow, it is safeguarded that the first fluid stream will be deflected in the direction of the flow channel, particularly in the direction of the grooves and respectively of the first transverse bores. In this embodiment, the above sealing disk can be omitted.

According to a preferred embodiment of the invention, a fluid stream sucked in via an intermediate inlet will be split, wherein, subsequently, a part of this further fluid stream will flow in the opposite direction. In this embodiment, is not only provided that the last rotor disk of the first pump device is configured to generate a counterflow but, instead, that preferably a plurality of rotor disks will generate a counterflow. These rotor disks are operative not only to generate a counterflow but also to compress, at the same time, the part of the further fluid stream that is flowing into the counterflow. Said part of the further fluid stream that is flowing into the counterflow will be merged with the first fluid stream within the first pump device. The first fluid stream together with the part of the further fluid stream that is conveyed into the opposite direction will flow into flow channels. Also here, the flow channels are preferably provided in the form of grooves arranged in the rotor shaft and extending in the longitudinal direction, or in the form of transverse bores, as described above. The first fluid stream will then flow together with said part of the further fluid stream through the flow channels in the direction of a further pump device. Within the further pump device, this fluid stream will exit again from the at least one flow channel so that, within the further pump device, this fluid stream will be merged with the second part of the further fluid stream sucked via the intermediate inlet.

According to a further preferred embodiment, the individual above-described embodiments are at least partially combined with each other. Particularly, the provision—described in connection with the first embodiment—of a through hole at least in the first rotor disk of the further pump device can be combined with the provision of at least one flow channel so that one part of the first fluid stream will flow through the at least one through hole and one part will flow through the at least one flow channel.

BRIEF DESCRIPTION OF THE DRAWINGS

The invention will be explained in greater detail hereunder with reference to the accompanying drawings.

In the drawings.

DETAILED DESCRIPTION

Figure 1:
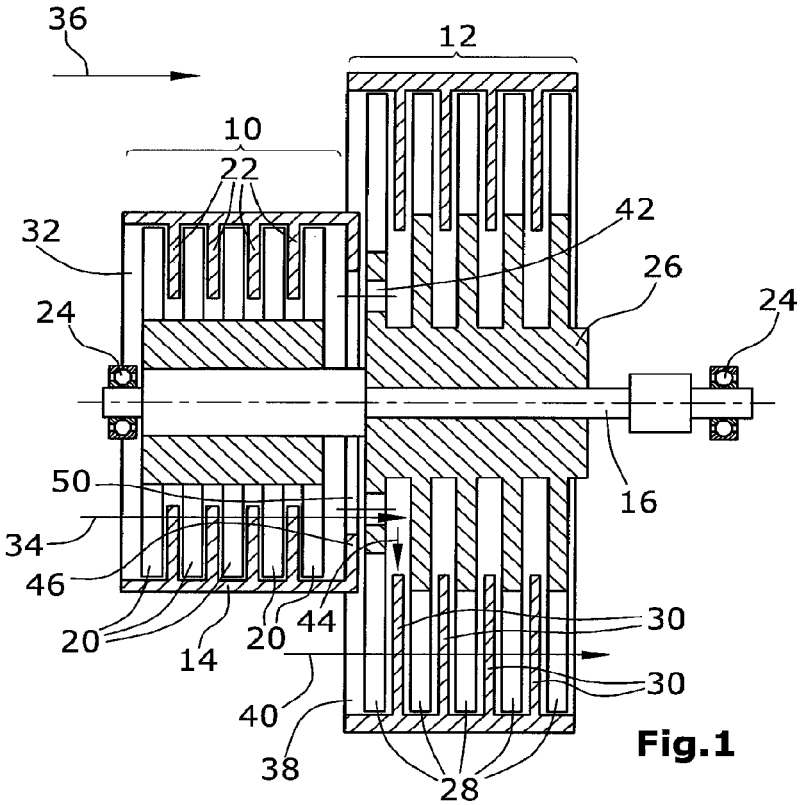
FIG. 1 is a schematic sectional view of a first embodiment of a part of a multi-inlet vacuum pump.

FIG. 1 illustrates that part of a multi-inlet vacuum pump which is of relevance for the present invention. This part of the multi-inlet vacuum pump comprises a first pump device 10 and a further, or second, pump device 12 which are arranged in a common housing. In said housing, there can additionally be provided, as shown on the right-hand side in FIG. 1, a third pump device such as e.g. a Holweck stage.

The first pump device 10 comprises a rotor element 18 arranged on a rotor shaft 16. In the illustrated embodiment, rotor element 18 comprises five radially oriented rotor disks 20. The rotor disks 20 comprise rotor vanes for transport of fluid, particularly gas. Between adjacent rotor disks 20, stationary stator disks 22 are arranged. The stator disks 22 are fixedly held in housing 14 e.g. with the aid of rings.

Rotor shaft 16, which in the illustrated embodiment is supported via two bearings 24, also carries a further, or second, rotor element 26 of second pump device 12. In the illustrated embodiment, said second rotor element 26 likewise comprises five rotor disks 28. Also between said rotor disks 28, stator disks 30 are arranged in a stationary manner while fastened to housing 14 optionally via stator rings. The rotor disks 28 again comprise vanes for transport of fluid, arranged in an outer region which in FIG. 1 is illustrated without being marked by hatched lines.

First pump device 10 is operative to suck gas through a main inlet 32 into housing 14. Thereby, a first fluid stream 34 is generated in the direction of second pump device 12 and respectively in the conveying direction 36. The conveying direction 36 corresponds to the main conveying direction from the main inlet 32 towards an outlet which, when viewed in the conveying direction, is provided behind the last pump device, i.e. in FIG. 1 on the right-hand side in the housing.

Housing 14 further comprises an intermediate inlet 38. The intermediate inlet is arranged within housing 14 between first pump device 10 and second pump device 12. Via intermediate inlet 38, a second fluid stream 40 is generated, again in the conveying direction. Said second fluid stream 40 will be conveyed, by means of the second pump device 12 and an optional further pump device downstream thereof, in the direction of the pump outlet. Particularly, in multi-inlet pumps of the configuration according to the illustrated embodiment, a high vacuum exists at main inlet 32 and a slightly lower vacuum at intermediate inlet 38. In the illustrated embodiment, in order to be able to generate a maximum possible suction capacity, i.e. a low vacuum, also at intermediate inlet 38, the radius of the rotor disks 28 of second pump device 12 is larger than the radius of the rotor disks 20 of first pump device 10.

Figure 2:
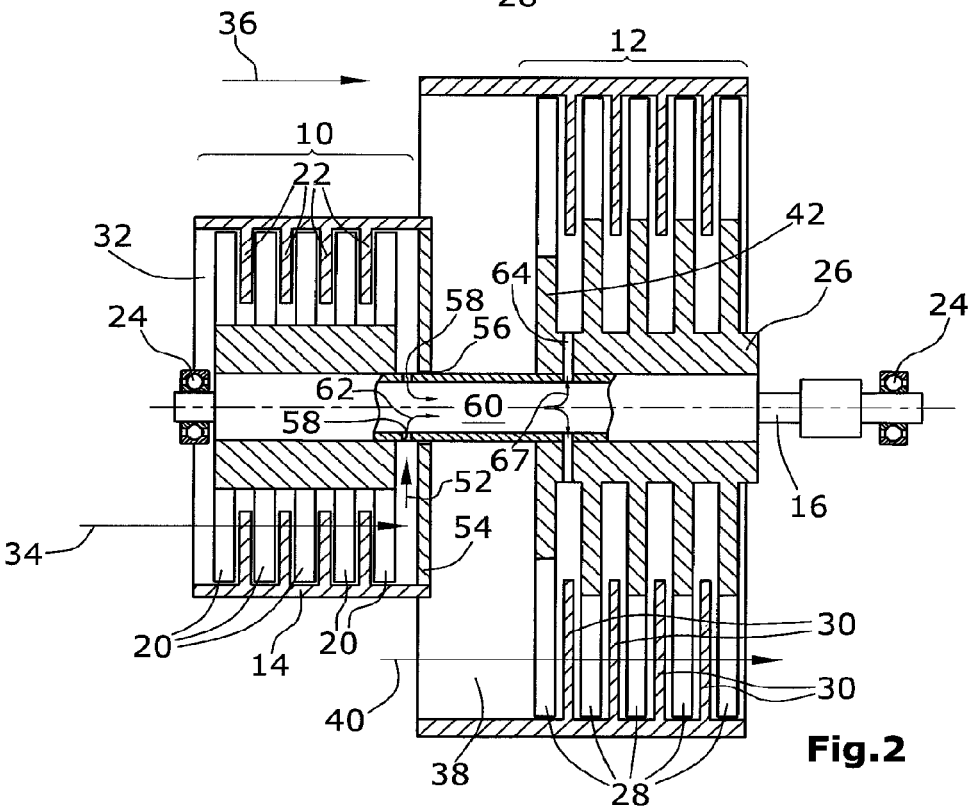
FIG. 2 is a schematic sectional view of a second embodiment of a part of a multi-inlet vacuum pump.

According to the embodiment of the invention illustrated in FIG. 1, a merging of the two fluid streams 34,40 will take place only with the second pump device 12. In the embodiment depicted in FIG. 2, this is obtained in that the first rotor disk 28—shown on the left in FIG. 2—of second pump device 12 is provided with a through opening 42. This through opening 42 preferably comprises a plurality of individual openings arranged on a circular line which is concentric with the rotor shaft. By the provision of the through opening 42, the first fluid stream 34 will first flow via the through opening 42 into the region of the two rotor disks 28 of second pump device 12 which in FIG. 2 are shown on the left side. Between the first two—or left—rotor disks 28 of second pump device 12, the first fluid stream will then flow radially toward the outside as indicated by arrow 44, thus causing the two fluid streams 34,40 to be merged between the first and second rotor disks 28 of second pump device 12. Since no merging of the two fluid streams 34,40 occurs in the region of intermediate inlet 38, more-favorable partial pressures can be achieved in the region of intermediate inlet 38. This is of advantage particularly in cases where different gas mixtures are sucked through main inlet 32 and intermediate inlet 38.

Said through opening 42 and respectively the individual openings of through opening 42 are provided within that region where the vanes of first rotor disk 28 are arranged. In the Figure, the region of the vanes is shown un-marked by hatched lines.

To safeguard that the first fluid stream 34 will flow as completely as possible via through opening 42 with resultant avoidance of a merging of the two fluid streams in the region of intermediate inlet 38, the illustrated embodiment is additionally provided with a housing wall 46. This housing wall 46 is arranged between the two pump devices 10,12 and is oriented radially. Housing wall 46 is fixedly connected to housing 14 and extends in the direction of rotor shaft 16. Thus, the first fluid stream 34, after passing through the first pump device 10, will flow through a circular opening 50 and further via the via through opening 42 of first rotor disk 28 and then, while passing between the first and second rotor disks 28 of second pump device 12, will enter the second pump device 12.

In the context of the second preferred embodiment shown in FIG. 2, components identical or similar to those of the first embodiment are marked by the same reference numerals.

The essential difference of the second embodiment shown in FIG. 2 resides in that the first rotor disk 28 of second pump device 12 does not comprise through openings 42. Instead, the first fluid stream 34 will be deflected radially inwards (arrow 52) at the end of the first pump device. For this purpose, a sealing disk 54 is connected to the housing or the stator rings. Said sealing disk 54 extends radially inward in a manner similar to housing wall 46 in the embodiment according to FIG. 1 and is sealed against rotor shaft 16 by a sealing gap 56.

A further difference of the second embodiment shown in FIG. 2 consists in that said shaft 16 is formed as a hollow shaft so that the first fluid stream 34 will flow through transverse bores 58 into the interior space 60 of hollow shaft 16 (arrow 62). Preferably, a plurality of transverse bores 58 are arranged, with preference symmetrically, on the circumference of hollow shaft 16.

Downstream of the first transverse bores 58 when viewed in the flow direction 36, second transverse bores 64 are formed in the hollow shaft. Also here, it is preferred that a plurality of second transverse bores 64 are symmetrically distributed on the circumference. The position of second transverse bore 64 is selected to the effect that the fluid will flow in the direction of arrow 67 via the transverse bores 64 into second pump device 12 wherein, in the presently illustrated embodiment, the inflow of fluid will occur between the first and second rotor disks 28 of second pump device 12. In the illustrated embodiment, there is thus formed a flow channel 58,60,64 connecting an outlet of the first pump device to a region within the second pump device; in the illustrated embodiment, this region is the region between the first and second rotor disks 28 of second pump device 12. The second transverse bores 64 can also terminate e.g. between the second and third, the third and the fourth, and so forth, of the rotor disks 28 of second pump device 12. Further, it is possible to provide a plurality of planes of transverse bores so that transverse bores terminate e.g. between the first and second as well as between the second and third rotor disks 28.

The second fluid stream 40 will flow in via intermediate inlet 38, as provided also in the embodiment shown in FIG. 1, and will be conveyed by the second pump device 12 in the direction of the outlet (not shown) of the multi-inlet vacuum pump. As in the first embodiment (FIG. 1), the merging of the two fluid streams 34,40 will take place e.g. between the first and second rotor disks 28 of second pump device 12.

Figure 3:
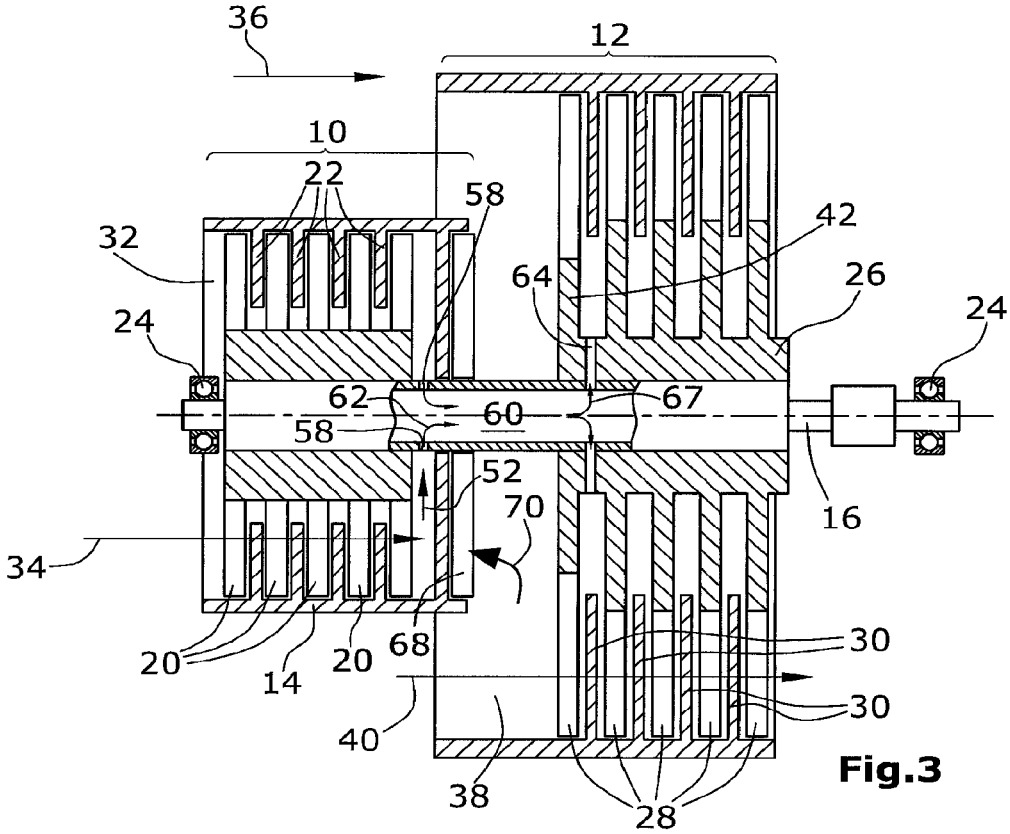
FIG. 3 is a schematic sectional view of a third embodiment of a part of a multi-inlet vacuum pump.

The third embodiment shown in FIG. 3 is similar to the second embodiment shown in FIG. 2, so that components identical or similar to those of the second embodiment are marked by the same reference numerals.

The essential difference between the embodiments shown in FIG. 2 and FIG. 3 resides in that the third embodiment (FIG. 3) does not comprise a sealing disk 54. Instead, a final rotor disk 68—on the right-hand side in FIG. 3—of the first pump device 10 is designed in such a manner that the rotor disk 68 will convey the fluid, in the direction marked by arrow 70, oppositely to the main conveying direction 36 of the multi-inlet vacuum pump. This is realized in that the vanes of rotor disk 68 point into the opposite direction. Because of the conveying direction of rotor disk 68, the first fluid stream cannot pass through rotor disk 68. This has the consequence that the first fluid stream 34, in a manner corresponding to the second embodiment (FIG. 2), will be conveyed radially inward (arrow 52) and will flow through the first transverse bores 58 into the interior space 60 of the hollow rotor shaft 16. The rotor disk 68 by which a small part of the second fluid stream 40 will be conveyed oppositely to the main conveying direction 36, will thus have a good sealing effect. In this manner, it is avoided that the two fluid streams 34,40 may happen to merge already in the region of intermediate inlet 38. In a manner corresponding to the second embodiment (FIG. 2), the first fluid stream will be conveyed through the flow channel 58,60,64 within the second pump device 12. Herein, the second transverse bores 64 are arranged within the hollow shaft 16 in such a manner that the first fluid stream will enter the second pump device 12 by passing between the first and second rotor disks 28 thereof.

Figure 4:
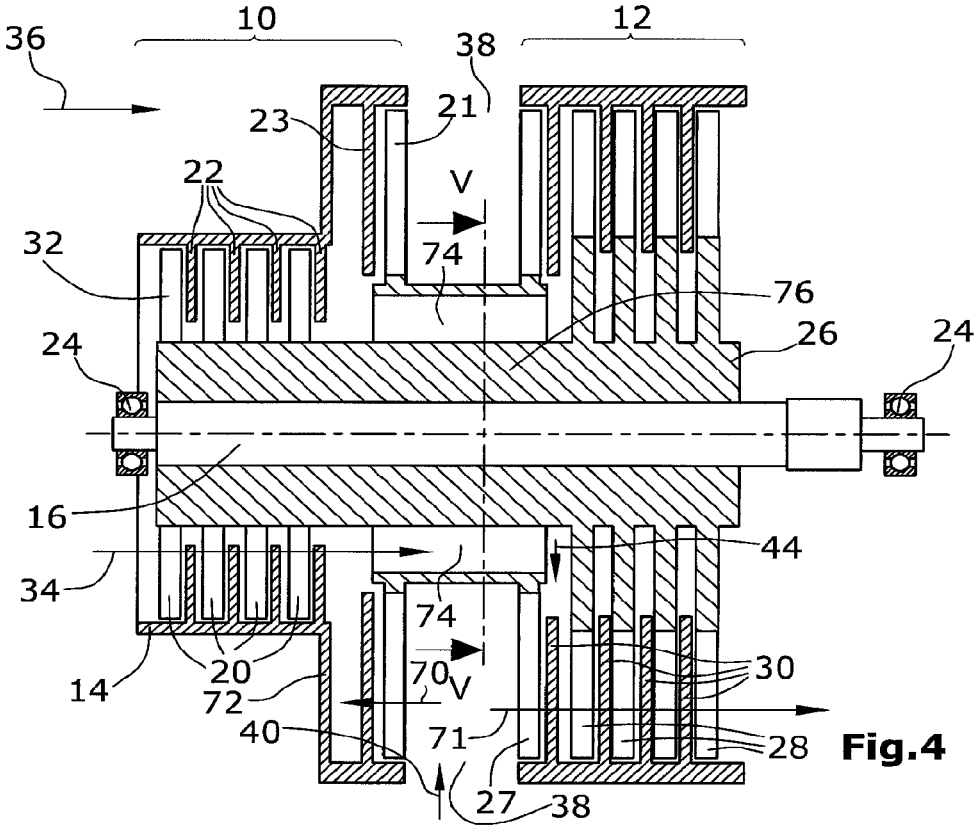
FIG. 4 is a schematic sectional view of a fourth embodiment of a part of a multi-inlet vacuum pump.
Figure 5:
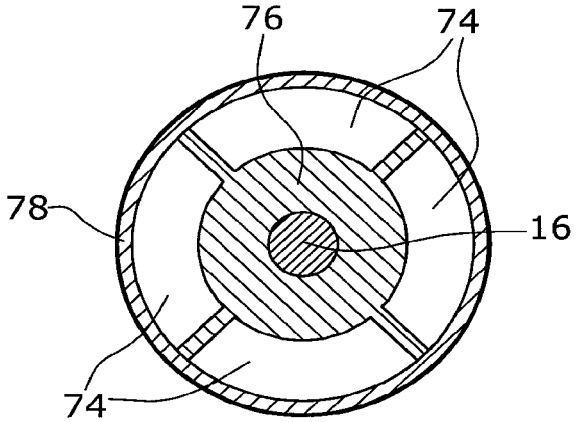
FIG. 5 is a schematic sectional view taken along the line V-V in FIG. 4.

In the context of the fourth preferred embodiment illustrated in FIGS. 4 and 5, identical or similar components are again marked by the same reference numerals.

According to this further preferred embodiment of the invention, as shown in FIG. 4, the fluid stream 40 sucked via intermediate inlet 38 will be split into two fluid streams 70,71 immediately after entering the vacuum pump. In a manner corresponding to the embodiment shown in FIG. 3, the partial fluid stream 70 will be conveyed in a direction opposite to the main conveying direction 36. Thereby, a counterflow is effected within the first pump device 10. This couterflow is generated by the vanes of rotor disk 21 and by the stator disk 23 fixedly connected to housing 14. In the illustrated embodiment, the rotor disk 21 and the associated stator disk 23 have a larger diameter than the other rotor disks 20 and stator disks 22 of the first pump device. Preferably, the outer diameters of the rotor disk 21 and of the stator disk 23 substantially correspond to those of the rotor disks 28 and respectively the stator disks 30 of the second or further pump device 12.

Due to the counterflow generated by said partial fluid stream 70, the first fluid stream 34 does not exit from the first pump device in the region of intermediate inlet 38. Instead, the partial fluid stream 70 and first fluid stream 34 will be merged in a region 72 of first pump device 10. Said region 72 has a substantially annular shape.

The merged fluid stream composed of the first fluid stream 34 and the partial fluid stream 70 will then flow through flow channels which in the illustrated embodiment are formed as grooves 74. The grooves 74 can be arranged directly in shaft 16. In the illustrated embodiment, an intermediate element 76 is arranged on shaft 16. Said intermediate element 76 is fixedly attached to shaft 16, e.g. by a shrink-on mounting process. The provision of intermediate element 76 makes it possible to arrange the flow channels 74 relative to shaft 16 at a radial offset towards the outside. This arrangement of the flow channels or grooves 74 advantageously allows the first fluid stream 34 to flow into the grooves 74 without having to be deflected. For forming the flow channels 74, a shell 78 is arranged around the intermediate element 76. Instead of using an intermediate element 76, it is also possible to form the rotor shaft 16 as a stepped shaft.

Said shell 78, shaped as a circular cylinder, does not only serve for forming the flow channels 74 but in the illustrated embodiment is used also for support of said rotor disk 21 generating the counterflow 70.

In the illustrated embodiment, a first rotor disk 77 of second pump device 12 is not supported by second rotor element 26 but again by said shell 78. This has the advantage of ensuring in a simple manner that the medium flowing through the grooves 74 will be merged with the further fluid stream and respectively the partial fluid stream 71 no sooner than within the second pump device. In the illustrated embodiment, the merging between the fluid streams will occur between the rotor disk 27 and the adjacent rotor disk 28, both of said rotor disks 27,28 being rotor disks of the second pump device 12.

The flow channels formed as grooves 74 that have been described with reference to the fourth embodiment (FIGS. 4 and 5) can also be provided in the embodiments shown in FIGS. 2 and 3. In this case, one would have to provide, instead of the transverse bores 58,64 or in addition thereto, a rotor shaft 16 formed with grooves in the manner corresponding to the fourth embodiment (FIGS. 4 and 5).

The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof.

The invention claimed is:

1. A multi-inlet vacuum pump comprising:

a first pump device including a first rotor element with a plurality of first rotor disks serially arranged in the conveying direction, at least one further pump device including a further rotor element with a plurality of further rotor disks serially arranged in the conveying direction, a main inlet for sucking therethrough a first fluid stream by the first pump device, said first fluid stream being conveyed in the direction of said further pump device, at least one intermediate inlet for sucking therethrough a second fluid stream by the second pump device, said second fluid stream being conveyed in the direction of a pump outlet, and a first transverse bore which connects the first pump device to a region in the further pump device, the first transverse bore being arranged at least partially within a rotor shaft of the first rotor element extending in the conveying direction and being arranged between the last rotor disk of the first pump device and a sealing disk arranged in the outlet region of the first pump device and extending from the pump housing to the rotor shaft, wherein a process of merging the two fluid streams occurring within the vacuum pump is performed in a region not located within said intermediate inlet.

2. The multi-inlet vacuum pump according to claim 1, wherein said merging of the two fluid streams is performed at least primarily within said at least one further pump device, preferably between two adjacent further rotor disks of said further pump device.

3. The multi-inlet vacuum pump according to claim 1, wherein the diameter of the second rotor disks is at least partially larger than the diameter of the first rotor disks.

4. The multi-inlet vacuum pump according to claim 1, wherein, in the conveying direction, at least the first rotor disk of said further pump device comprises a through opening for inflow of the first fluid stream therethrough into the second pump device.

5. The multi-inlet vacuum pump according to claim 4, wherein said through opening is arranged radially within the first rotor disk of second pump device that carries the rotor vanes.

6. The multi-inlet vacuum pump according to claim 1, further including:

a preferably radially arranged housing wall between the first pump device and the second pump device, said housing wall being preferably sealingly connected to an outer housing wall.

7. The multi-inlet vacuum pump according to claim 6, wherein a narrow sealing gap is provided between said housing wall and a rotor shaft.

8. A multi-inlet vacuum pump comprising:

a first pump device including a first rotor element with a plurality of first rotor disks serially arranged in the conveying direction, at least one further pump device including a further rotor element with a plurality of further rotor disks serially arranged in the conveying direction, a main inlet for sucking therethrough a first fluid stream by means of the first pump device, said first fluid stream being conveyed in the direction of said further pump device, at least one intermediate inlet for sucking therethrough a second fluid stream by means of the second pump device, said second fluid stream being conveyed in the direction of a pump outlet, wherein a process of merging the two fluid streams occurring within the vacuum pump is performed in a region not located within said intermediate inlet, and a flow channel which connects the first pump device to a region within said further pump device, wherein said flow channel is arranged at least partially within a rotor shaft carrying the first rotor element and the second rotor element.

9. The multi-inlet vacuum pump according to claim 8, further including:

at least one transverse bore formed in the rotor shaft in the region of an outlet of the first pump device, and preferably by at least one second transverse bore formed in the rotor shaft and terminating between two adjacent rotor disks of the second pump device.

10. A multi-inlet vacuum pump comprising:

a first pump device including a first rotor element with a plurality of first rotor disks serially arranged in the conveying direction, at least one further pump device including a further rotor element with a plurality of further rotor disks serially arranged in the conveying direction, a main inlet for sucking therethrough a first fluid stream by means of the first pump device, said first fluid stream being conveyed in the direction of said further pump device, at least one intermediate inlet for sucking therethrough a second fluid stream by means of the second pump device, said second fluid stream being conveyed in the direction of a pump outlet, wherein a process of merging the two fluid streams occurring within the vacuum pump is performed in a region not located within said intermediate inlet, and a flow channel which connects the first pump device to a region within said further pump device, wherein said flow channel is formed by at least one groove extending in the longitudinal direction in the rotor shaft, said at least one groove being radially closed preferably by a shell and/or a rotor element.

11. The multi-inlet vacuum pump according to claim 10, wherein said rotor shaft comprises a plurality of grooves distributed preferably symmetrically on the circumference and extending in the longitudinal direction of rotor shaft.

12. A multi-inlet vacuum pump comprising:

a first pump device including a first rotor element with a plurality of first rotor disks serially arranged in the conveying direction, at least one further pump device including a further rotor element with a plurality of further rotor disks serially arranged in the conveying direction, a main inlet for sucking therethrough a first fluid stream by means of the first pump device, said first fluid stream being conveyed in the direction of said further pump device, at least one intermediate inlet for sucking therethrough a second fluid stream by means of the second pump device, said second fluid stream being conveyed in the direction of a pump outlet, wherein a process of merging the two fluid streams occurring within the vacuum pump is performed in a region not located within said intermediate inlet, and wherein at least the last rotor disk of the first pump device is configured in such a manner that a part of the second fluid stream sucked through the intermediate inlet will be conveyed oppositely to the conveying direction in the direction of the first pump device.

* * * * *